US008696195B2

(12) United States Patent
Gonthier

(10) Patent No.: US 8,696,195 B2
(45) Date of Patent: Apr. 15, 2014

(54) BALANCE SPRING BOOT

(75) Inventor: Bertrand Gonthier, Vetroz (CH)

(73) Assignee: Eta SA Manufacture Horlogère Suisse, Grenchen (CH)

( * ) Notice: Subject to any disclaimer, the term of this patent is extended or adjusted under 35 U.S.C. 154(b) by 196 days.

(21) Appl. No.: 13/344,208

(22) Filed: Jan. 5, 2012

(65) Prior Publication Data

US 2012/0176869 A1 Jul. 12, 2012

(30) Foreign Application Priority Data

Jan. 6, 2011 (EP) ..... 11150327

(51) Int. Cl.
*G04B 17/06* (2006.01)

(52) U.S. Cl.
USPC ..... 368/176; 368/170

(58) Field of Classification Search
USPC ..... 368/176, 175, 170
See application file for complete search history.

(56) References Cited

U.S. PATENT DOCUMENTS

| | | | | |
|---|---|---|---|---|
| 273,138 | A * | 2/1883 | Oldroyd | 368/176 |
| 398,987 | A * | 3/1889 | Teske | 368/172 |
| 2,604,754 | A * | 7/1952 | Favret | 368/175 |
| 3,136,116 | A * | 6/1964 | Walton | 368/176 |
| 3,136,160 | A * | 6/1964 | Randall | 374/116 |
| 4,201,042 | A * | 5/1980 | Visconti et al. | 368/170 |
| 5,907,524 | A * | 5/1999 | Marmy et al. | 368/175 |
| 2007/0091729 | A1* | 4/2007 | Takahashi | 368/170 |
| 2011/0292770 | A1* | 12/2011 | Damasko | 368/175 |

FOREIGN PATENT DOCUMENTS

| | | |
|---|---|---|
| CH | 40792 A | 7/1907 |
| CH | 408 787 A | 7/1965 |
| DE | 1 164 931 B | 3/1964 |

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

Balance spring boot (1) to be driven onto an index (10) for adjusting a balance spring (20) pivoting relative to an axis (D) and including two pins (2, 3), parallel to each other in one direction (D1) and arranged for limiting the radial beat of a balance spring (20) inserted between said pins, and including a means of resting on said index (10) arranged, when said balance spring boot (1) is assembled on said index (10), for adjusting said direction (D1) parallel to said pivot axis (D). Said spring boot (1) includes in a parallel direction to said direction (D1) a sight hole (4) clear so as to allow visualisation by an operator or instrument of said pins (2, 3) and the portion of a balance spring (20) inserted between them at a distance from and/or in contact with one and/or the other of said pins (2, 3).

17 Claims, 2 Drawing Sheets

Fig. 4
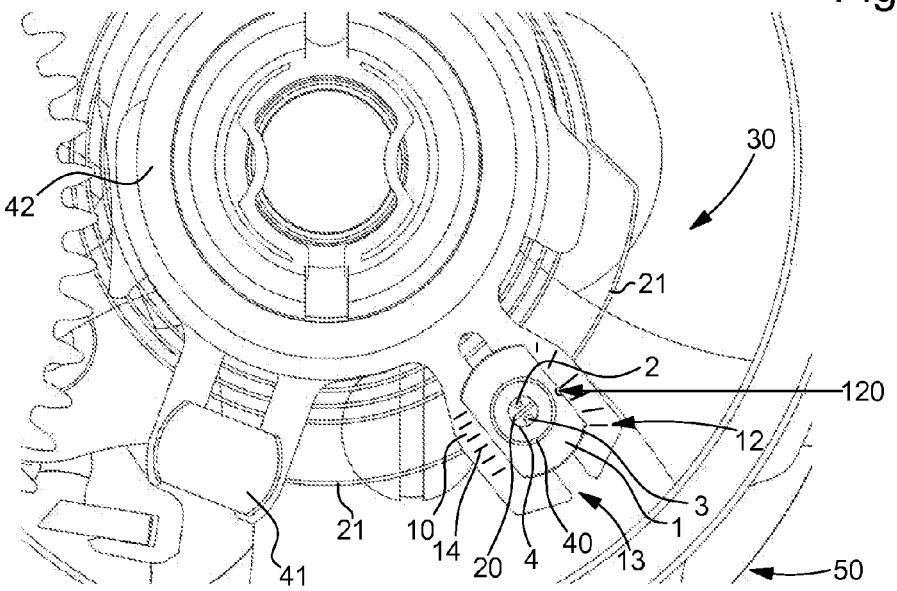
Fig. 5
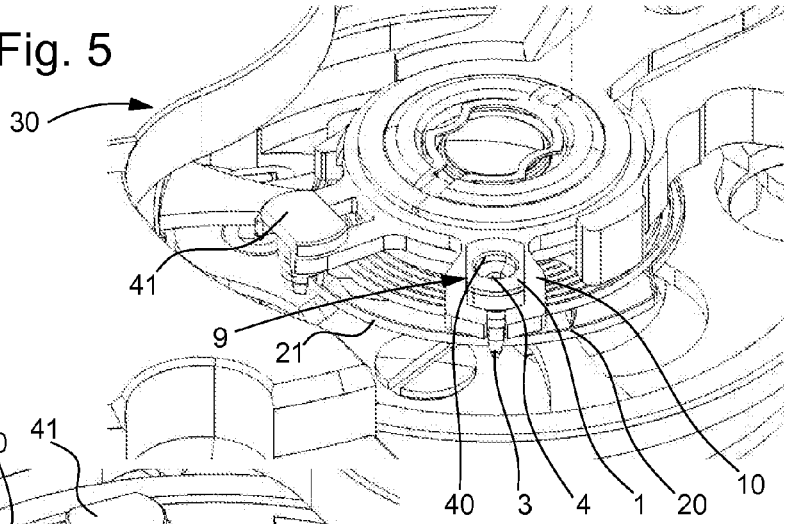
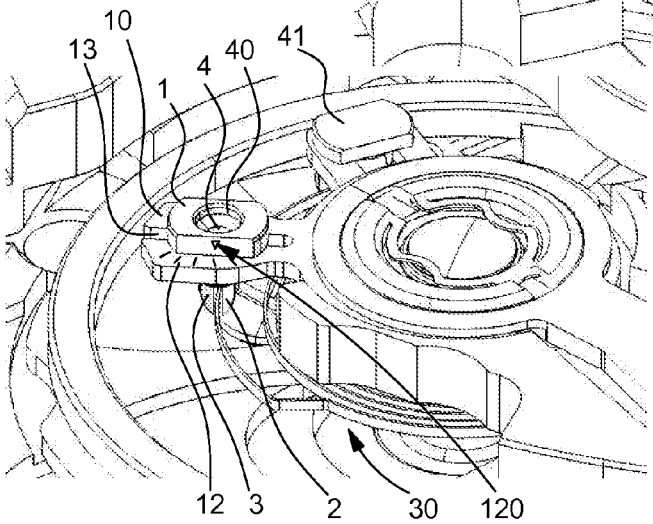
Fig. 6

BALANCE SPRING BOOT

This application claims priority from European Patent Application No. 11150327.2 filed Jan. 6, 2011, the entire disclosure of which is incorporated herein by reference.

FIELD OF THE INVENTION

The invention concerns a balance spring boot, arranged to be driven onto an index for adjusting a timepiece balance spring, wherein said index is arranged to be pivotably mounted relative to an axis parallel to the pivot axis of said balance spring or merged therewith, said balance spring boot includes two pin shoulders, which are parallel to each other in one direction, separated by a distance and arranged for limiting the radial beat of the balance spring inserted between them, and also polished to support said balance spring with minimum friction, and said balance spring boot includes means for resting on said index arranged, in the position where said balance spring boot is mounted on said index, for adjusting said direction of said pin shoulders, parallel to said pivot axis of said index.

The invention further includes an index for adjusting a timepiece balance spring, arranged to be pivotably mounted relative to an axis parallel to the pivot axis of said balance spring or merged therewith, and including a balance spring boot of this type.

The invention further concerns a regulating assembly for a timepiece movement, including at least one balance spring pivoting about a pivot axis, and supported by a balance spring boot of this type or by an index of this type.

The invention also concerns a timepiece movement including at least one such regulating assembly.

The invention also concerns a timepiece including at least one such timepiece movement.

BACKGROUND OF THE INVENTION

In order regulate the isochronism of a timepiece regulating assembly, in particular of a sprung balance, it is known to act on the active portion of the balance spring, which is attached at the inner end thereof to a collet secured to the balance, and at the external end thereof to a balance spring stud, secured to a balance cock which is secured to the plate of the movement. In order to alter this active portion, and in particular to obtain a shorter length than the total length defined by the place where the balance spring is set in the stud, an index is used, which may be an index provided with two pins, or an index comprising a balance spring boot carrying the two pins. These two pins define two parallel, polished shoulders on which the balance spring can rest and slide with minimum friction. At a given time, if the balance spring is resting on one of the pins, the active portion thereof is the portion comprised between the place where it is pinned up to the collet, on the one hand, and where it rests on the pin, on the other hand. If the balance spring is not resting on either of the pins, its active portion is equal to its total length. If the pins are very far apart, this creates a losing rate, and the variation amplitude is large, which is not conducive to a regular rate. If they are too close to each other, this creates a gain, and there is a risk of the balance spring being deformed, which is worse.

Since the operator cannot see the relative positions of the balance springs and the pins, he has to proceed by trial and error, or use empirical adjustments, for example adjusting the pins when the balance is at rest, so that the balance spring is centred relative to the pins, allowing play of a half-thickness of the balance spring on both sides. However, like any empirical adjustment, this does not optimise operation, but simply constitutes an adjustment which conventionally considered acceptable. Moreover, this positioning is theoretical, and difficult to carry out because of the impossibility of introducing gauges or suchlike to regulate the spacing between the pins.

The situation is complicated by the combination of possible adjustments to the balance spring stud and the pivoting of the index, in particular, and it is difficult for the operator to control what is actually happening to the balance spring. It is thus more advantageous for the operator to be able to use means informing him of the exact position of the balance spring, in order to perform the operations of centring and adjusting the beat of said balance spring.

CH Patent No 408787 in the name of Vuachet discloses a balance spring boot, which is formed by a plate folded into a V-shape, resting via edges on top of a radial hole in an index. This plate includes a slot for the passage of the spring, the edges of the slot acting as pins for limiting the beat of the balance spring. The operator can see the balance spring through the radial hole in the index, but cannot tell its position relative to the edges of the slot, which are concealed by the structure of the plate, and which are not visible through the hole in the index.

CH Patent No. 40792 in the name of Beyner discloses an index that includes two moving fingers which hold the balance spring. The latter is visible from above between the two fingers. However this is not a moving balance spring boot, but an index body whose position is fixed, apart from the pivoting thereof relative to the axis of the balance spring, and it is not possible to act on the relative angular position between the pins and the spring.

SUMMARY OF THE INVENTION

The invention proposes to overcome the problems of the prior art by proposing a simple and economical solution which allows the operator good visibility of the respective positions of the balance spring and the curb pins during the operations of centring and adjusting the beat of the balance spring, and can thus position the balance spring with precision.

The invention therefore concerns a balance spring boot, arranged to be driven onto an index for adjusting a timepiece balance spring, wherein the index is arranged to be pivotably mounted relative to an axis parallel to the pivot axis of said balance spring or merged therewith. Said balance spring boot includes two pin shoulders, which are parallel to each other in one direction, separated by a distance, and arranged to limit the radial beat of a balance spring inserted between them, and also polished to support said balance spring with minimum friction. Said balance spring boot includes a means for resting on said index arranged, in the position in which said balance spring boot is mounted on said index, for adjusting said direction of said pin shoulders, parallel to said pivot axis of said index. The invention is characterized in that said balance spring boot includes a sight hole in a parallel direction to said direction of said pin shoulders, said hole being clear to allow visualisation by an operator or an optical instrument of said pin shoulders and the portion of a balance spring inserted between them at a distance from and/or in contact with one and/or the other of said pins.

According to a feature of the invention, aligned with said sight hole, said balance spring boot includes, a means for receiving an optical instrument or an optical magnifying instrument, or a pick counter.

The invention also concerns an index for adjusting a timepiece balance spring which is arranged to be pivotably mounted relative to a parallel axis to the pivot axis of said balance spring or merged therewith, including a balance spring boot of this type, characterized in that said balance spring boot is driven onto said index so that said direction is parallel to said axis.

According to a feature of the invention, said index includes at least one passage for the insertion and driving in of said balance spring boot.

The invention also concerns a regulating assembly for a timepiece movement, including at least one balance spring pivoting about a pivot axis, and held by a balance spring boot of this type or an index of this type, characterized in that said direction is parallel to the pivot axis of said balance spring.

The invention also concerns a timepiece movement including at least one such regulating assembly.

The invention also concerns a timepiece including at least one such timepiece movement.

BRIEF DESCRIPTION OF THE DRAWINGS

Other features and advantages of the invention will appear more clearly upon reading the following detailed description, with reference to the annexed drawings, in which:

FIG. 4 shows a schematic, partial, top view of a timepiece including a timepiece movement comprising a regulating member, which includes an index and a balance spring boot according to the invention.

FIGS. 5 and 6 show schematic, partial and perspective views of details of the timepiece of FIG. 4.

DETAILED DESCRIPTION OF PREFERRED EMBODIMENTS

The invention concerns a balance spring boot 1. This balance spring boot 1 is arranged to be driven onto an index 10 for adjusting a timepiece balance spring 20. This index 10 is arranged in the usual manner to be pivotably mounted relative to an axis D parallel to the pivot axis of the balance spring or merged therewith.

Figure 3:
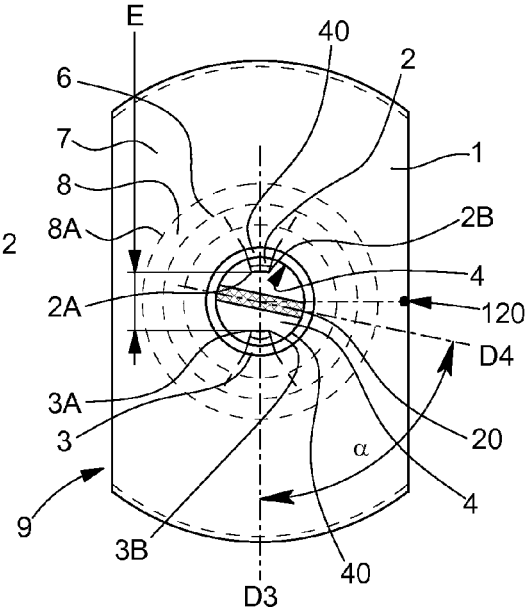
FIG. 3 shows a schematic end view along direction A of FIG. 1 of a balance spring boot according to the invention.

This balance spring boot 1 includes two pin shoulders 2 and 3, which are parallel to each other along a direction D1 and separated by a distance E, and arranged for limiting the radial beat of a balance spring 20 inserted between said pin shoulders. These pin shoulders are polished, at least on the possible support surfaces for balance spring 20, to provide minimum friction support for said balance spring 20. As shown in FIG. 3, balance spring 20 may either be free between the two pin shoulders 2 and 3, as illustrated in the Figure, or bear on one or several of the surfaces comprised between surfaces 2A and 2B which delimit pin shoulder 2 or comprised between the surfaces 3A and 3B which delimit pin shoulder 3.

Balance spring boot 1 includes a means for resting on said index 10 which is arranged, in the position where balance spring boot 1 is mounted on said index 10, for adjusting the direction D1 of pin shoulders 2 and 3 parallel to the pivot axis D of index 10.

According to the invention, balance spring boot 1 has a sight hole 4 in a parallel direction to direction D1 of pin shoulders 2 and 3. This sight hole 4 is clear to allow visualisation by an operator or an optical instrument of pin shoulders 2 or 3 and the portion of a balance spring 20 inserted between said pin shoulders at a distance from and/or in contact with one or other of pins 2, 3, as seen in FIG. 3.

Figure 2:
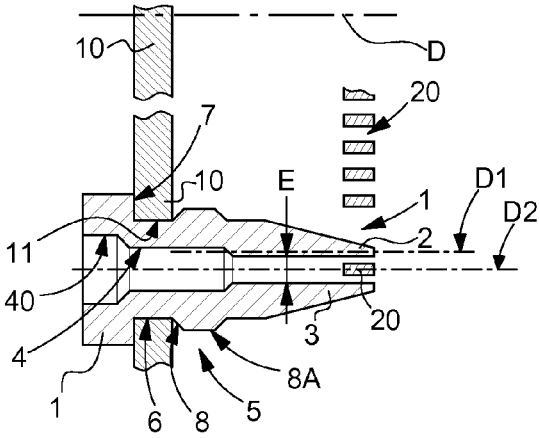
FIG. 2 shows a schematic longitudinal cross-section of a balance spring boot of the invention, along a median axis parallel to the two pin shoulders comprised therein.

Preferably, to assemble boot 1 quickly and easily on an index 10, as seen in FIG. 2, along an axis D2 parallel to direction D1 and substantially median relative to the pin shoulders 2 and 3 and at the opposite end to and at a distance from pin shoulders 2 and 3, boot 1 includes a clamping holding means 5, which is arranged for stretching said index 10. This clamping holding means 5 stretches index 10 around an adjustment area 6 comprised in boot 1, for the play-free cooperation thereof with an index 10, and to hold said index 10 by clamping.

In a preferred embodiment visible in FIG. 2, the clamping holding means 5 includes a support collar 7, arranged to rest on an index 10 on the opposite side to pin shoulders 2 and 3, and a holding surface 8, which, on the side of pin shoulders 2 and 3, is arranged for holding boot 1 on an index 10 after it is driven thereon. For example, this holding means is made in the form of a substantially conical shoulder, or similar, extending between the adjustment area 6, which is, for example, made in the form of a cylindrical shoulder of axis D2, and a shoulder 8A of larger diameter than that of adjustment area 6, for holding boot 1 on index 10 after said boot has been driven thereon.

Thus, preferably, in an orthogonal plane to direction D2, holding surface 8 has at least one section greater than that of a passage 11 comprised in said index 10 for receiving boot 1, and adjustment area 6 is made with a substantially complementary profile to that of said passage 11.

To make this assembly possible, boot 1 can preferably be elastically deformed, at least on holding surface 8, allowing said boot to be inserted, by being driven into said passage 11, which is provided in index 10 for receiving boot 1.

Figure 1:
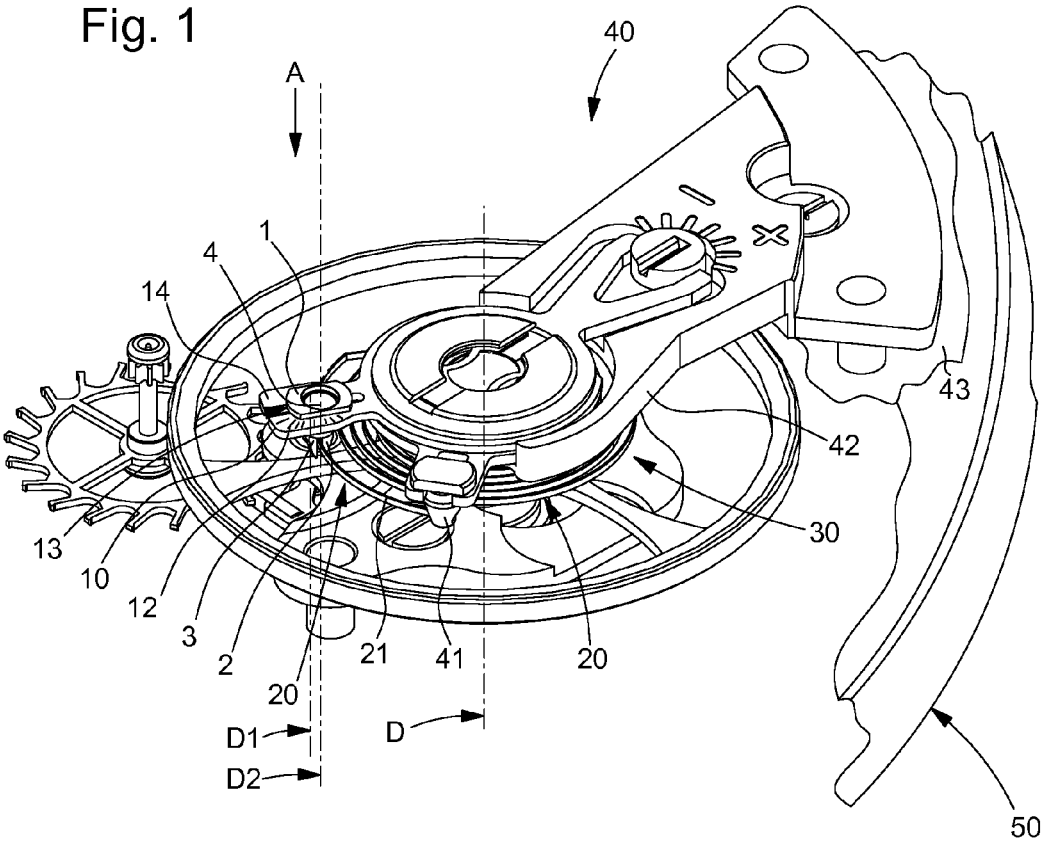
FIG. 1 shows a schematic, partial and perspective view of a timepiece including a movement comprising a regulating assembly, which includes an index and a balance spring boot according to the invention.

Advantageously, to perform adjustments, boot 1 includes a gripping means 9, for example in the form of two parallel shoulders allowing said boot to be gripped by a tool such as a wrench, as seen in FIGS. 1 and 3, so as to control the pivoting of said boot around an axis D2, which is parallel to direction D1 and substantially median relative to pin shoulders 2 and 3, after the boot is driven onto said index 10.

To improve the working comfort of the user, balance spring boot 1 advantageously includes, aligned with sight hole 4, a means 40 for receiving an optical instrument, such as a bore 40, as seen in FIGS. 2 and 3, or an integrated magnifying optical instrument, such as an optical lens or a pick counter or similar.

The invention also includes an index 10 for adjusting a timepiece balance spring 20, which is arranged to be pivotably mounted relative to an axis D parallel to the pivot axis of balance spring 20, or merged therewith, including a boot 1 as described hereinbefore, driven onto index 10, such that direction D1 is parallel to axis D.

Preferably, this index 10 includes at least one passage 11 for the insertion and driving in of boot 1. Preferably, index 10 and boot 1 are matched such that passage 11 has a substantially complementary profile to that of an adjustment area 6 comprised in boot 1, for clamping said boot onto index 10.

Advantageously, to store settings and for in-service monitoring, index 10 includes a graduated marking means 12 for determining the angular position of boot 1 about an axis D2, parallel to direction D1 and substantially median relative to shoulder pins 2 and 3 of boot 1, which then includes a complementary marking means 120, for example in the form of a pointer.

The pivoting of boot 1 relative to index 10 thus allows relative positioning between a direction D3, joining the pin shoulders 2 and 3 in a perpendicular plane to axis D2, and a direction D4, tangential to the local direction of spring 20 in the same plane, and the adjustment of the angle a that these two directions D3 and D4 form between them close to the value of 90°. Therefore, depending upon the observations of the operator and the settings that he chooses, it is possible to adjust boot 1 so as to encourage contacts between spring 20 and the boot at one or other of areas 2A, 2B, 3A or 3B.

In a particular variant, index 10 includes a substantially radial slot 13 relative to pivot axis D of index 10. This slot 13 acts as a receiving surface for boot 1 and the sides thereof form a passage 11 which cooperates with an adjustment area 6 of boot 1. Index 10 can then include other complementary radial marking means 14 for storing the radial position of boot 1 with complementary marking means of boot 1, for example in the form of a pointer (not shown).

FIG. 1 illustrates a timepiece 50 including a timepiece movement 40. The movement includes a plate 43, which carries a balance cock 42 for supporting a regulating assembly 30, typically including a sprung balance assembly. The latter includes a balance spring 20, which is attached via the last coil 21 thereof, to a balance spring stud 41 integral with balance cock 42. At a distance from stud 41, this last coil 21 of spring 20 is threaded between the two pin shoulders 2 and 3 of the boot of the invention, which is itself mounted on an index 10.

Thus the invention also concerns a regulating assembly 30 for a timepiece movement, including at least one balance spring 20 pivoting about a pivot axis, and held by a boot 1, or by an index 10, arranged such that direction D1 is parallel to the pivot axis of balance spring 20.

The invention also concerns a timepiece movement 40 including at least one such regulating assembly 30.

The invention also concerns a timepiece 50 including at least one such timepiece movement 40.

What is claimed is:

1. A balance spring boot, arranged to be driven onto an index for adjusting a timepiece balance spring, wherein the index is arranged to be pivotably mounted relative to an axis parallel to the pivot axis of said balance spring or merged therewith, said balance spring boot includes two pin shoulders, which are parallel to each other in one direction, separated by a distance, and arranged to limit the radial beat of a balance spring inserted between said pin shoulders, and also polished to support said balance spring with minimum friction; said balance spring boot includes a means for resting on said index arranged, in the position in which said balance spring boot is mounted on said index, for adjusting said direction of said pin shoulders, parallel to said pivot axis of said index, wherein said balance spring boot includes a sight hole in a parallel direction to said direction of said pin shoulders, said hole being clear to allow visualisation by an operator or an optical instrument of said pin shoulders, and the portion of a balance spring inserted between said pin shoulders at a distance from and/or in contact with one and/or the other of said pins.

2. The balance spring boot according to claim 1, wherein it includes, along an axis parallel to said direction and substantially median relative to said pin shoulders and at an opposite end to and at a distance from said pin shoulders, a clamping holding means, arranged to stretch said index around an adjustment area comprised in said balance spring boot, for the play-free cooperation thereof with said index, and for holding said index by clamping.

3. The balance spring boot according to claim 2, wherein said clamping holding means includes a support collar arranged to rest on said index on the opposite side to said pin shoulders, and a holding surface arranged for holding, on the side of said pin shoulders, said balance spring boot on said index after said boot is driven thereon.

4. The balance spring boot according to claim 3, wherein, along an orthogonal plane to said direction, said holding surface has at least one section larger than that of a passage comprised in said index for receiving said balance spring boot.

5. The balance spring boot according to claim 3, wherein it can be elastically deformed, at least on said holding surface, for the insertion and driving thereof into a passage, which is provided in said index for receiving said boot.

6. The balance spring boot according to claim 1, wherein it includes a gripping means for controlling the pivoting thereof about an axis, parallel to said direction and substantially median relative to said pin shoulders, after said boot has been driven onto said index.

7. The balance spring boot according to claim 1, wherein it includes, aligned with said sight hole, a means for receiving an optical instrument or an optical magnifying instrument, or a pick counter.

8. The index for adjusting a timepiece balance spring which is arranged to be pivotably mounted relative to an axis, parallel to the pivot axis of said balance spring or merged therewith, including a balance spring boot according to claim 1, wherein said balance spring boot is driven onto said index so that said direction is parallel to said axis.

9. The index according to claim 8, wherein it includes at least one passage for the insertion and driving in of said balance spring boot.

10. The index according to claim 8, wherein it includes a graduated marking means for determining the angular position of said balance spring boot around an axis parallel to said direction and substantially median relative to said pin shoulders.

11. The regulating assembly for a timepiece movement, including at least one balance spring pivoting about a pivot axis, and supported by a balance spring boot according to claim 1, wherein said direction is parallel to the pivot axis of said balance spring.

12. The regulating assembly for a timepiece movement, including at least one balance spring pivoting about a pivot axis, and supported by an index according to claim 8, wherein said direction is parallel to the pivot axis of said balance spring.

13. The timepiece movement including at least one regulating assembly including at least one balance spring pivoting about a pivot axis, and supported by a balance spring boot according to claim 1, wherein said direction is parallel to the pivot axis of said balance spring.

14. The timepiece movement including at least one regulating assembly including at least one balance spring pivoting about a pivot axis, and supported by an index according to claim 8, wherein said direction is parallel to the pivot axis of said balance spring.

15. The timepiece including at least one timepiece movement according to claim 13.

16. The timepiece including at least one timepiece movement according to claim 14.

17. The balance spring boot according to claim 1, wherein the sight hole extends along an interior of the spring boot.

* * * * *